US005853490A

United States Patent [19]

Dunn et al.

[11] Patent Number: 5,853,490

[45] **Date of Patent: *Dec. 29, 1998**

[54] USE OF BICARBONATES AND CARBONATES IN METAL CLEANING FORMULATIONS TO INHIBIT FLASH RUSTING

[75] Inventors: Steven Dunn, Hillsborough; Steven A. Bolkan, Hopewell; Francis Cala, Highland Park; Anthony Winston, East Brunswick, all of N.J.

[73] Assignee: Church & Dwight Inc., Princeton, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 597,684

[22] Filed: Feb. 6, 1996

Related U.S. Application Data

[63] Continuation of Ser. No. 311,252, Sep. 23, 1994, abandoned.

[51] Int. Cl.[6] ..... C23G 1/14; C23G 1/16; C23G 1/19; C23F 11/16

[52] U.S. Cl. ..... 134/2; 134/40; 422/7

[58] Field of Search ..... 134/2, 40; 422/13, 422/17, 7

[56] References Cited

U.S. PATENT DOCUMENTS

| | | | |
|---|---|---|---|
| 2,661,314 | 12/1953 | Criddle | 134/29 |
| 3,808,051 | 4/1974 | Schoenholz et al. | 134/2 |
| 3,887,497 | 6/1975 | Vlvilo | 252/526 |
| 4,698,173 | 10/1987 | Hansen | 252/70 |
| 5,011,551 | 4/1991 | Emeric et al. | 148/248 |
| 5,055,230 | 10/1991 | Clubley et al. | 252/389.62 |
| 5,234,506 | 8/1993 | Winston et al. | 134/40 |
| 5,275,752 | 1/1994 | Hansen | 252/70 |
| 5,296,041 | 3/1994 | Vincl et al. | 134/40 |
| 5,383,962 | 1/1995 | Hansen | 106/14.21 |
| 5,397,397 | 3/1995 | Awad | 134/1 |
| 5,464,477 | 11/1995 | Awad | 134/1 |

OTHER PUBLICATIONS

*Corrosion and Corrosion Control,* Whlig H.H., John Wiley & Sons, 1963, pp. 102–105.

*Primary Examiner*—Jill Warden
*Assistant Examiner*—Alexander Markoff
*Attorney, Agent, or Firm*—Irving Fishman

[57] ABSTRACT

Prevention of flash rusting of iron-containing substrates is achieved by contacting the substrates with aqueous solutions containing carbonate and/or bicarbonate salts. The treatment process can be effected during cleaning of the substrates with an aqueous alkaline cleaner or during a post cleaning step such as during rinsing of the substrates subsequent to cleaning.

13 Claims, No Drawings

USE OF BICARBONATES AND CARBONATES IN METAL CLEANING FORMULATIONS TO INHIBIT FLASH RUSTING

This application is a continuation of application Ser. No. 08/311,252, filed Sep. 23, 1994, now abandoned.

BACKGROUND OF THE INVENTION

The present invention relates generally to aqueous metal cleaning compositions. In particular, this invention is directed to aqueous metal cleaning compositions useful in the treatment of iron-containing substrates so as to prevent flash rusting of these metal substrates.

Existing cleaners to remove contaminants such as grease, dirt, oils and the like from metal substrates have typically comprised organic solvents with or without special additives. These organic solvents have been adequate to achieve good cleaning of most dirty, greasy, metal substrates. A great number of these organic solvents have been employed to produce metallic surfaces free from contamination. These solvent cleaning compositions generally employ various halogenated hydrocarbons and non-halogenated hydrocarbons, of significant quantity industry wide for cleaning and degreasing of metal surfaces, and the degree of success with each of the solvent compositions is generally dependent upon the degree of cleanliness required on the resultant surface.

Recently, however, the various hydrocarbon and halogenated hydrocarbon metal cleaning solvent compositions previously employed have come under scrutiny in view of the materials employed, and in particular, the environmental impact from the usage of the various materials. This is particularly so in the case of parts cleaning which is done in closed environments such as garages and the like or for even home usage in view of the close human contact. Even the addition of devices to parts washers which can reduce spillage, fire and excessive volatilization of the cleaning solvent are not sufficient to alleviate present environmental concerns.

Although the halogenated hydrocarbon solvents such as chlorofluorocarbons (CFCs) and trichloromethane, methylene chloride and trichloroethane (methyl chloroform) are widely used in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

The non-halogenated hydrocarbon solvents such as toluene and Stoddard solvent and like organic compounds such as ketones and alcohols on the other hand are generally flammable, have high volatility and dubious ability to be recycled for continuous use. These, plus unfavorable safety, environmental and cost factors, put this group of solvents in a category which is unattractive for practical consideration. Most useful organic solvents are classified as volatile organic compounds (VOCs) which pollute the atmosphere, promote formation of toxic ozone at ground level, and add to the inventory of greenhouse gases.

In order to eliminate the various negative aspects of the known chemical washing and degreasing systems, it has, therefore, been suggested that an aqueous detergent system be used so as to overcome some of the inherent negative environmental and health aspects of prior art solvent cleaning systems. Unfortunately, aqueous cleaning systems are not without their own problems as related to metal cleaning. For example, certain of the aqueous cleaners are exceedingly alkaline having pHs of 13 and above including sodium hydroxide or include organic solvents such as alkanolamines, ethers alcohols, glycols, ketones and the like. Besides being highly corrosive, these exceedingly high alkaline aqueous solutions are highly toxic and can be dangerous to handle requiring extreme safety measures to avoid contact with skin. Organic solvent-containing aqueous cleaners present the problems of toxicity, volatility or the environment expressed previously. On the other hand, it is most difficult to obtain an aqueous detersive solution at moderate pH which is effective in removing the greases and oils which contaminate metal surfaces and which would not be corrosive to the metal substrate.

As stated immediately above, one disadvantage of using aqueous systems to clean metal surfaces is the potential to corrode or discolor the surfaces. While aqueous cleaning solutions having a high pH such as formed from sodium hydroxide are often more corrosive than aqueous solutions having a relatively low pH such as formed by mildly alkaline detergents, corrosion and discoloration are still problematic with the more mild solutions. One particular problem with respect to corrosion using aqueous metal cleaning solutions is manifest in the cleaning of iron-based metals. Thus, it has been found that iron-based metals treated with aqueous based systems and then removed from the aqueous solution begin to rust almost immediately. This phenomenon has been characterized as flash rusting. Inasmuch as it takes longer for metal parts to dry subsequent to treatment with aqueous based cleaners as compared to drying times upon treatment with organic solvent based cleaners due to the high surface tension of water, the potential for flash rusting occurring on iron-containing metal parts is a serious drawback to the use of aqueous based cleaners to clean such metal substrates.

For example, it is not uncommon for suppliers to provide steel parts that may lay unused up to six weeks before such parts are used in a final fabrication process. Typically, the supplied parts are provided with a surface coating to prevent rust during storage. This surface coating is typically in the form of a light oil which must be cleaned before the parts are then processed or fabricated. If such parts are cleaned, it is not uncommon that such parts may sit two to three weeks before fabrication. In such instances, rusting becomes a major problem. Thus, it is necessary to again clean the parts immediately prior to usage, either with a liquid cleaning process or some kind of mechanical treatment such as sanding to remove rust. These additional cleaning steps obviously add non-value added costs to the fabrication process.

Accordingly, it is an object of this invention to provide an aqueous metal cleaning composition which is effective to cleaning grease, oil, dirt and other contaminants from a metal surface and yet have a relatively moderate pH so as not to be excessively corrosive to the substrate and irritating to human skin.

Another object of the invention is to provide an aqueous metal cleaning composition which can be used effectively either by immersion or impingement so as to effectively remove dirt, grease, oil and other contaminants from metal substrates and which is safe to use and not a hazard to the environment on use and upon disposal.

Still another object of the present invention is to provide an aqueous metal cleaning composition which is not corrosive to metal parts in general and, can greatly reduce flash rusting of iron-containing metal substrates.

Still yet another object of the present invention is to provide a method of treating iron-containing metal substrates so as to prevent flash rusting of such substrates and provide prolonged rust protection to the substrates without requiring an additional cleaning step to remove the rust protectant.

These and other objects of the invention can be readily ascertained from the description of the invention which follows.

SUMMARY OF THE INVENTION

It has now been found that the treatment of iron-based metal substrates with carbonate or bicarbonate salts or mixtures thereof is effective in greatly reducing, if not eliminating, the phenomenon of flash rusting and, accordingly, the present invention is concerned with a method of treating iron-based substrates and surfaces with aqueous solutions of carbonate or bicarbonate salts or mixtures thereof. The carbonate and/or bicarbonate salts can be used either as part of an aqueous cleaning solution to remove contaminants from the iron-based substrates or surfaces or such salts can be used in an aqueous rinsing or other post treatment step so as to prevent the flash rusting of the iron-containing substrates and, as well, provide prolonged rust protection for such substrates so that such substrates can be stored without rusting prior to use.

DETAILED DESCRIPTION OF THE INVENTION

The metal substrates of the present invention which can be effectively treated to prevent rust formation include any iron-based substrate of any structure type. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein the metal surfaces have to be cleaned. Of particular importance are iron alloys of such substrates such as steel.

The carbonate and bicarbonate salts useful in this invention are any alkali metal or ammonium carbonate and/or bicarbonate salt. Preferred salts are those of potassium and sodium especially if such salts are used in a cleaning solution. The preferred carbonate salts include potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate and the double salts and mixtures thereof. The bicarbonate salts include potassium bicarbonate and sodium bicarbonate and mixtures thereof. Ammonium salts are particularly useful when treatment is effected subsequent to cleaning such as during a rinsing step since the treatment with ammonium salts such as ammonium bicarbonate does not leave any salt residues after a drying stage.

While not wishing to be bound by any particular theory, it is believed that the treatment of the iron-based substrates with the carbonate and/or bicarbonate salts results in the formation of an iron carbonate on the surface of the substrate. The iron carbonate is believed to provide a coating which protects the substrate from further oxidation and the phenomenon of flash rusting. The iron carbonate surface also protects the iron-containing substrate from rusting for relatively prolonged periods of time up to about four weeks. This prolonged protection is important inasmuch as previously stated, often, such iron-based substrates are stored for several weeks prior to fabrication into final product form.

One method of treating the iron-containing substrates in accordance with the present invention is to provide the carbonate and/or bicarbonate salts as alkali metal salts in a cleaning solution so as to remove dirt, grease, oil, etc. from the iron-containing substrates and at the same time provide the rust preventive treatment. A useful cleaning composition comprises an alkalinity providing agent which comprises an alkaline salt electrolyte and a nonemulsifying, low foaming surfactant or mixture of surfactants. In accordance with the invention, alkali metal carbonate and/or alkali metal bicarbonate salts can make up all or a portion of the alkalinity providing agent.

The useful aqueous alkaline metal cleaning solutions of this invention comprising the carbonate/bicarbonate-containing cleaning composition in water are organic solvent free and have a pH of between about 7.5 and 11.0 so as to render these solutions substantially less harmful to use and handle than highly alkaline aqueous cleaners such as those formed from sodium hydroxide or aqueous alkanolamine solutions. The solutions preferably have a pH of at least 8.0 to less than 11.0 to effectively clean the typical metal substrates. Most preferably, the aqueous alkaline cleaning solutions have a pH from about 8.0 to 10.0 which is effective to remove the dirt, grease, oil and other contaminants from the metal surface without causing tarnishing or discoloration of the metal substrate and yet allow the solutions to be used, handled and disposed of without burning or irritating human skin.

Although not preferred, other suitable alkaline salts can be used in addition to the alkali metal carbonate and/or bicarbonate salts. These other salts include the alkali metal ortho or complex phosphates. Examples of alkali metal orthophosphates include trisodium or tripotassium orthophosphate. The complex phosphates are especially effective because of their ability to chelate water hardness and heavy metal ions. The complex phosphates include, for example, sodium or potassium pyrophosphate, tripolyphosphate and hexametaphosphates. It is preferred to limit the amount of phosphates, however, to less than 1 wt. % (phosphorus) inasmuch as phosphates are ecologically undesirable being a major cause of eutrophication of surface waters. Additional suitable alkaline salts useful in the metal cleaning compositions of this invention include the alkali metal borates, acetates, citrates, tartrates, succinates, phosphonates, edates, etc. It is preferred to maintain the compositions of this invention silicate-free due to the resultant high pH and difficulty in formulating a composition which will remain soluble in aqueous solution at pH's of 11.0 or less when silicates are present.

To improve cleaning efficacy of the cleaning compositions of the present invention, it is needed to add one or more surfactants. Nonionic surfactants are preferred as such surfactants are best able to remove the dirt, grease and oil from the metal substrates. The preferred surfactants utilized in the cleaning compositions of the present invention are characterized as ones which do not readily emulsify the contaminants in aqueous solution so as to form a substantially uniform phase with the aqueous solution in the cleaning bath. Thus, the preferred surfactants penetrate the contaminants on the surface of the metal so as to remove same from the surface but at the same time allow the formation of a distinct and separated contaminant phase or phases within the aqueous cleaning solution so as to allow the separated contaminant phase to be readily removed from solution such as by filtration, skimming and the like. It is relatively easy to determine whether a surfactant will emulsify the contaminant.

Preferably, it is believed that the alkoxylated surfactants are best capable of improving the detersive action of the alkaline solution without substantially emulsifying the contaminants to prevent their ready separation from the aqueous cleaning solution and bath containing same. In general, ethoxylated alcohol, ethylene oxide-propylene oxide block copolymers, ethoxylated-propoxylated alcohols, alcohol alkoxylate phosphate esters, ethoxylated amines and alkoxylated thioethers are believed to be useful surfactants either alone or in combination in the cleaning compositions and solutions of the present invention.

Among the most useful surfactants in view of the ability thereof to remove grease and oil are the nonionic alkoxylated thiol surfactants. The nonionic alkoxylated (ethoxylated) thiol surfactants of the present invention are known and are described for example in U.S. Pat. Nos. 4,575,569 and 4,931,205, the contents of both of which are herein incorporated by reference. In particular, the ethoxylated thiol is prepared by the addition of ethylene oxide to an alkyl thiol of the formula R—SH wherein R is alkyl in the presence of either an acid or base catalyst.

The relative quantity of thiol and alkylene oxide reactants determine the average alkylene oxide number of the alkoxylate product. In the alkoxylated thiol surfactant of this invention an adduct number in the range from about 3 to 20, particularly from about 3 to 15 is preferred. Accordingly, preference can be expressed in the practice of the invention for a molar ratio of alkylene oxide reactant to thiol reactant which is in the range from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Preferred examples of other alkoxylated surfactants include compounds formed by condensing ethylene oxide with a hydrophobic base formed by the condensation of propylene oxide with propylene glycol. The hydrophobic portion of the molecule which exhibits water insolubility has a molecular weight of from about 1,500 to 1,800. The addition of polyoxyethylene radicals to this hydrophobic portion tends to increase the water solubility of the molecule as a whole and the liquid character of the product is retained up to the point where polyoxyethylene content is about 50 percent of the total weight of the condensation product. Examples of such compositions are the "Pluronics" sold by BASF.

Other suitable surfactants include: the condensation of ethylene oxide with the product resulting from the reaction of propylene oxide and ethylene-diamine or from the product of the reaction of a fatty acid with sugar, starch or cellulose. For example, compounds containing from about 40 percent to about 80 percent polyoxyethylene by weight and having a molecular weight of from about 5,000 to about 11,000 resulting from the reaction of ethylene oxide groups with a hydrophobic base constituted of the reaction product of ethylene diamine and excess propylene oxide, and hydrophobic bases having a molecular weight of the order of 2,500 to 3,000 are satisfactory.

In addition, the condensation product of aliphatic alcohols having from 8 to 18 carbon atoms, in either straight chain or branched chain configuration, with ethylene oxide and propylene oxide, e.g., a coconut alcohol-ethylene oxide—propylene oxide condensate having from 1 to 30 moles of ethylene oxide per mole of coconut alcohol, and 1 to 30 moles of propylene oxide per mole of coconut alcohol, the coconut alcohol fraction having from 10 to 14 carbon atoms, may also be employed.

Also useful are alkoxylated alcohols which are sold under the tradename of "Polytergent SL-Series" surfactants by Olin Corporation or "Neodol" by Shell Chemical Co. The polycarboxylated ethylene oxide condensates of fatty alcohols manufactured by Olin under the tradename of "Polytergent CS-1" are also believed to be effective such as in combination with the above Polytergent SL-Series surfactants. An effective surfactant which also provides antifoam properties is "Polytergent SLF-18" also manufactured by Olin.

Polyoxyethylene condensates of sorbitan fatty acids, alkanolamides, such as the monoalkoanolamides, dialkanolamides, and amines; and alcohol alkoxylate phosphate esters, such as the "Klearfac" series from BASF are also useful surfactants in the compositions of this invention.

The polyethylene oxide/polypropylene oxide condensates of alkyl phenols are not particularly preferred as such surfactants are not readily biodegradable.

The aqueous metal cleaning compositions of the present invention comprising the carbonate and/or bicarbonate salts and the surfactant or mixture of surfactants also preferably include other adjuvants such as corrosion inhibitors, carboxylated polymeric stabilizing agents and hydrotropes to maintain the active ingredients of the composition in aqueous solution.

A suitable corrosion inhibitor which can be added to the aqueous metal cleaning compositions of this invention include magnesium and/or zinc ions. Preferably, the metal ions are provided in water soluble form. Examples of useful water soluble forms of magnesium and zinc ions are the water soluble salts thereof including the chlorides, nitrates and sulfates of the respective metals. If the alkalinity providing agents are primarily the alkali metal carbonates, bicarbonates or mixtures of such agents, magnesium oxide can be used to provide the Mg ion. The magnesium oxide is water soluble in such solutions and is a preferred source of Mg ions. The magnesium oxide appears to reduce coloration of the metal substrates even when compared with the chloride salt.

In order to maintain the dispersibility of the magnesium and/or zinc corrosion inhibitors in aqueous solution, in particular, under the mildly alkaline pH conditions most useful in this invention, it has been found advantageous to include a carboxylated polymer to the solution. The carboxylated polymer may be generically categorized as water-soluble carboxylic acid polymers or vinyl addition polymers. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersible in water. The molecular weight of these polymers may vary over a broad range although it is typical to use polymers having average molecular weights ranging between 1,000 up to 1,000,000. In a preferred embodiment of the invention these polymers have a molecular weight of 100,000 or less and, most preferably, between 1,000 and 10,000.

The water-soluble polymers of the type described above are often in the form of copolymers which are contemplated as being useful in the 4 practice of this invention provided they contain at least 10% by weight of $$-\overset{\overset{\displaystyle O}{\|}}{C}-OM$$

groups where M is hydrogen, alkali metal, ammonium or other water-solubilizing radicals. The polymers or copolymers may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

Especially useful maleic anhydride polymers are selected from the group consisting of homopolymers of maleic anhydride, and copolymers of maleic anhydride with vinyl acetate, styrene, ethylene, isobutylene, acrylic acid and vinyl ethers. These polymers can be easily prepared according to standard methods of polymerization.

The carboxylated polymers aid in maintaining the magnesium and zinc compounds in solution, thereby preventing the precipitation of the corrosion inhibitor from solution and consequent degradation of corrosion protection. Further, the carboxylated polymers prevent scaling due to precipitation of water hardness salts formed during reaction with the alkaline salts of the cleaning compositions of this invention.

The hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam. Among the most useful of such hydrotropes are those which comprise the alkali metal salts of intermediate chain length linear monocarboxylic fatty acids, i.e., $C_7$–$C_{13}$. Particularly preferred are the alkali metal octanoates and nonanoates.

The metal cleaning compositions of this invention comprise from about 20 to 80 wt. % based on the dry components of the alkaline salts, 5 to 50 wt. % surfactant, 0 to 10 wt. %, preferably, 0.5 to 5 wt. % of the corrosion inhibitor compound, 0–5 wt. %, preferably, 0.3 to 2 wt. % of the carboxylated polymer and 0–30 wt. %, preferably, 2–25 wt. % of the hydrotrope. The dry composition is used in the aqueous wash solution in amounts of about 0.1–20 wt. %. preferably from about 0.2–5 wt. %. It is important in order to provide effective flash rust protection that the alkali metal carbonate be present in solution in amounts at least from about 0.01 wt. % to 10 wt. % of the wash solution. If an alkali metal bicarbonate salt is used, such salts should be present in amounts of at least 0.1 wt. % to 10 wt. % of the wash solution.

Most preferably, the metal cleaning compositions of the present invention are provided and added to the wash bath as an aqueous concentrate in which the dry components of the composition comprise from about 5–45 wt. % of the concentrate and, most preferably, from about 10–20 wt. %.

The aqueous concentrates of this invention preferably comprise 60–90% deionized water, 5–15 wt. % alkaline salts, and 2–10 wt. % surfactant, along with the optional ingredients comprising 1–5 wt. % of the hydrotrope, 0.05–5 wt. % of the corrosion inhibitor and 0.01–1 wt. % of any carboxylated polymer.

If the carbonate and/or bicarbonate salts are used in an aqueous metal cleaning solution, any method of contacting the cleaning solution with the metal components can be utilized. A useful method of cleaning such metal parts is in a parts washer. In parts washers the metal parts are contacted with the aqueous solution either by immersion or some type of impingement in which the aqueous cleaning solution is circulated or continuously agitated against the metal part or is sprayed thereon. Alternatively, agitation can be provided as ultrasonic waves. The cleaning solution is then filtered and recycled for reuse in the parts washer.

For any other type of cleaning such as cleaning continuous lengths of metal substrates, immersion and some type of impingement cleaning such as spraying can be utilized. In any case, it is best that the aqueous cleaning solutions be at an elevated temperature typically ranging from about 90° to 180° F. The contact time of the aqueous cleaning solution of with the metal substrates will vary depending upon the degree of contamination or broadly will range between about 1 minute to 30 minutes with 3 minutes to 15 minutes being more typical.

Besides use in an aqueous cleaning solution, the carbonate and/or bicarbonate salts may be used alone in a post cleaning step such as an aqueous rinse step or any other post cleaning treatment step. This post treatment step can be subsequent to a cleaning step which involves organic solvent cleaning or cleaning with an aqueous alkaline cleaning solution. In such a post treatment step, the carbonate and/or bicarbonate salts are simply contacted with the iron-containing substrates in aqueous solution to afford the flash rust preventing treatment. In such cases, the carbonate salts are again present in solution in amount of from 0.01 wt % to about 10 wt. % while the bicarbonate salts should be present in amounts of from about 0.1 wt. % to about 10 wt. %. In the post treatment step, ammonium carbonate and/or bicarbonate salts are particularly useful since such salts will not leave salt residue subsequent to drying the substrate.

For treatment of the iron-containing substrates in a post cleaning treatment process such as rinsing, any method of contacting the iron-containing substrates can be used including immersion, roll coating, spraying, etc. can be utilized. Contact time, again, generally will range from about 1 minute to about 30 minutes with 3 to 15 minutes being more typical.

EXAMPLE 1

Medium grade, unfinished steel wool was used as the test substrate. The steel wool was treated in various carbonate and bicarbonate-containing solutions at 160° F. for 4 hours and allowed to air dry. Observations were then made using a magnifying glass for the level of rust formed on the metal surface. The results were as shown in Table 1 below:

TABLE 1

| Concentration | Bicarbonate solution pH | Bicarbonate solution Results | Carbonate solution pH | Carbonate solution Results |
|---|---|---|---|---|
| 1.0% | 8.03 | No rust | 11.04 | No rust |
| 0.75% | 8.07 | No rust | 11.00 | No rust |
| 0.5% | 8.08 | trace rust | 10.92 | No rust |
| 0.25% | 8.06 | light rust | 10.80 | No rust |

Water Control pH 6.32 Heavy rusting

EXAMPLES 2 and 3

In a second study steel wool is treated with an aqueous metal cleaner. The wash solution contains 10% of the concentrate set forth in Table 2, shown below. After two hours the steel wool is shaken to remove attached water droplets and placed in a deionized water solution for 2 hours. It is then allowed to air dry. The results show trace rusting indicating that bicarbonates and carbonates in the cleaning solution are able to provide extended protection in the rinse.

TABLE 2

| | Example 2 | Example 3 |
|---|---|---|
| Sodium carbonate | 2.0 | 0.0 |
| Sodium bicarbonate | 2.0 | 0.0 |
| Potassium carbonate | 8.0 | 15.0 |
| Polytergent SL-42 | 1.0 | 0.0 |
| Polytergent CS-1 | 0.2 | 0.0 |
| Polytergent S-405LF | 0.5 | 4.0 |
| Sodium nonanoate | 2.5 | 4.0 |
| Potassium silicate | 0.0 | 4.0 |
| Carbopol 625 | 0.0 | 0.9 |
| Water | 83.8 | 72.1 |

Polytergent SL-42 is an ethoxylated propoxylated alcohol manufactured by Olin Corp.
Polytergent CS-1 is a dicarboxylated ethoxylated alcohol manufactured by Olin Corp.
Polytergent S-405LF is a propoxylated ethoxylated alcohol manufactured by Olin Corp.
Carbopol 625 is a cross linked polyacrylic acid polymer.

EXAMPLES 4–6

Table III provides examples of formulations which can be added to rinse water as a rinse aid and to provide protection against flash rusting.

TABLE 3

| | Example 4 | Example 5 | Example 6 |
|---|---|---|---|
| Ammonium bicarbonate | 10.0 | 5.0 | 0.0 |
| Sodium carbonate | 0.0 | 0.0 | 8.0 |
| Sodium bicarbonate | 0.0 | 5.0 | 3.0 |
| Sodium caprylate | 0.0 | 1.0 | 1.5 |

TABLE 3-continued

| | Example 4 | Example 5 | Example 6 |
|---|---|---|---|
| Pluronic 25R4 | 0.0 | 0.5 | 0.0 |
| Plurafac RA-30 | 0.0 | 0.5 | 0.0 |
| Neodol 25-7 | 0.0 | 0.0 | 1.0 |
| Water | 90.0 | 88.0 | 86.5 |

Usage concentration: 0.1% to 5.0%
Plurafac RA-30 is a propoxylated ethoxylated alcohol.

Example 4 has the unique advantage of not leaving any salt residues after drying and is therefore particularly suited for rinsing high precision parts which must be completely residue free.

What is claimed is:

1. A method of treating iron containing substrates so as to simultaneously clean and prevent the formation of flash rust thereof comprising contacting contaminated surfaces of said substrates with an aqueous solution consisting essentially of carbonate salts in amounts of from about 0.01 to 10 wt % of said aqueous solution, bicarbonate salts in amounts of from about 0.1 to 10 wt % of said aqueous solution, at least one surfactant and an alkali metal salt of an intermediate chain length linear monocarboxylic fatty acid having carbons $C_7$–$C_{13}$, said contacting taking place for a sufficient time to remove contaminants from the surfaces of said substrates, wherein said aqueous solution has a pH range of from at least 8 to about 11.0.

2. The method of claim 1 wherein said carbonate salts and bicarbonate salts comprise alkali metal salts.

3. The method of claim 2 wherein said alkali metal salts comprise sodium or potassium salts.

4. The method of claim 1 wherein said carbonate salts and bicarbonate salts comprise ammonium salts thereof.

5. The method of claim 1 wherein said iron-containing substrates comprise an iron alloy.

6. The method of claim 5 wherein said iron alloy is steel.

7. The method of claim 1 wherein said at least one surfactant comprises a nonionic surfactant.

8. The method of claim 1 wherein said contacting is done by immersing said substrate in said aqueous solution.

9. The method of claim 1 wherein said contacting takes place by spraying said substrate with said aqueous solution.

10. The method of claim 1 wherein said aqueous solution is free of organic solvent.

11. The method of claim 10 wherein said aqueous solution is free of silicates.

12. The method of claim 1 wherein said contacting is done at an elevated temperature ranging from about 90 to 180 degrees F.

13. The method of claim 1, wherein said alkali metal salts of intermediate chain length linear monocarboxylic fatty acids comprise octanoates or nonanoates.

* * * * *